US005290041A

United States Patent [19]

Kettelson

[11] Patent Number: 5,290,041

[45] Date of Patent: Mar. 1, 1994

[54] LAWN GAME USING HAND-THROWN PROJECTILES

[75] Inventor: Russell W. Kettelson, Waterford, Mich.

[73] Assignee: Paradigm International, Inc., Union Lake, Mich.

[21] Appl. No.: 11,738

[22] Filed: Feb. 1, 1993

[51] Int. Cl.[5] ..... A63B 63/00; A63B 65/00; A63B 67/00

[52] U.S. Cl. ..... 273/400; 273/428; 273/347

[58] Field of Search ..... 273/400, 317, 318, 398, 273/415, 420, 428, 347

[56] References Cited

U.S. PATENT DOCUMENTS 3,111,318 11/1963 Worthrop ..... 273/400 X
3,784,199 1/1974 Chmela ..... 273/398
3,982,762 9/1976 Milicic ..... 273/420
4,088,319 5/1978 Clarke ..... 273/317 X
4,212,460 7/1980 Kraft ..... 273/428 X
4,266,781 5/1981 Blue ..... 273/428 X
5,112,061 5/1992 Lamle ..... 273/411
5,171,021 12/1992 Orak ..... 273/428

*Primary Examiner*—William H. Grieb
*Attorney, Agent, or Firm*—Charles W. Chandler

[57] ABSTRACT

A game apparatus includes a series of hand-thrown projectiles and two cooperating ground targets. Each projectile includes a hollow-elongated projectile body that forms a tubular handle and a hollow bulbous nose. A quantity of water is located within the nose to concentrate the projectile weight in the nose. The projectile is thrown with an underhanded swinging motion so that the weighted nose constitutes the leading end of the projectile during flight. End surfaces of the projectile are blunt or rounded so that if the projectile should forcibly strike a person, there will be minimal injury to the struck person.

20 Claims, 2 Drawing Sheets

LAWN GAME USING HAND-THROWN PROJECTILES

BACKGROUND OF THE INVENTION

This invention relates to a game in which the participants throw elongated projectiles toward ground targets located 30 to 50 feet away from the point where the participants are standing. The game is broadly similar to the game of horseshoes.

PRIOR ART DEVELOPMENTS

In the conventional game of horseshoes, the participants throw U-shaped projectiles toward upstanding posts (or stakes) located 40 feet from the point where the participants are standing. Usually the projectiles are thrown with an underhanded motion, in a vertically descending arc toward the stake. The object of the game is to land the projectiles in positions either encircling the stake or as close as possible to the stake. Points are accumulated, based on the positions of the horseshoes in relation to the stake.

Another lawn game involves throwing darts toward a target area on the ground a specified distance from the throwing point. U.S. Pat. No. 3,982,762, issued to Tony Milicic on Sep. 28, 1976, describes the general features of such a game. The Milicic patent further shows and describes a dart construction that can be used in playing such a game.

The dart construction shown in the Milicic patent comprises a dart body having a hollow, conically-shaped head with a pointed tip designed to penetrate into the ground. A quantity of sand or metal pellets weights the head, to produce a desired flight path to a ground target.

The dart body further comprises an elongated rod extending rearwardly from the head. The rod has several radial vanes located a short distance behind the head. The extreme rear portion of the rod is used as a handle to throw the dart toward a ground target.

SUMMARY OF THE INVENTION

The present invention relates to a hand-thrown projectile and ground target useful in playing a game that is broadly similar to the above-mentioned game of lawn darts. A primary object of the invention is to provide a hand-thrown projectile having a convex rounded end such that if the projectile should inadvertently strike a person's body, the projectile nose will not penetrate or seriously injure the person's skin. The nose has a rounded blunt front surface. If the nose of the projectile should strike a person's body, the impact will be distributed over a relatively large area of the person's skin.

In a preferred form of the invention, the projectile comprises an elongated hollow body having a relatively long tubular handle and a relatively short hollow nose extending forwardly from the handle. The diameter of the nose is greater than the diameter of the handle, such that a quantity of flowable, dense filler material within the nose concentrates the weight of the projectile in the nose, rather than in the handle. The dense filler material can e.g. be sand, water or metal pellets.

The user grasps the projectile handle and throws it out with an underhanded swinging motion of his or her arm. The weighted nose pulls the projectile through the atmosphere a considerable distance, e.g. thirty or fifty feet, with a reasonably small human effort.

The tubular projectile handle has a diameter of about one inch. The handle terminates in a spherical or rounded rear end. Should a child attempt to use the handle as a sword or piercing element for injuring another person, the spherical end has sufficient area that it will not produce any serious injury. The handle is designed as a safety improvement over the rod-type handle construction shown in the above-mentioned U.S. Pat. No. 3,982,762.

In a preferred embodiment of the invention, the entire projectile body is a one-piece plastic molding, formed e.g. by a blow molding process. The hollow body has a relatively thin plastic wall with a uniform wall thickness, such that the body has a relatively low total weight (prior to adding the dense filler material into the hollow nose portion of the projectile). Manufacturing costs for the projectile are relatively low, because the hollow body requires a relatively small quantity of plastic material. Further, the preferred projectile can be formed in a single step molding operation; no assembling steps involving multiple component parts are required.

In the preferred practice of the invention, the projectile is used with a ground target that defines one or more upwardly facing depressions. Each depression is formed by two downwardly convergent plastic walls, such that when the projectile descends into the depression, the walls grip the nose. The moving projectile deflects each plastic wall, dissipating the projectile's energy. The projectile is deformed as it is wedged into the depression in the target.

The preferred target effectively captures a thrown projectile having a range of different trajectories. An aim of the invention is to provide a target that will substantially eliminate rebounding of a projectile off the target surface. The target has a hollow undersurface shaped so that two or more targets can be nested together and stored or packaged in a compact assembly.

THE DRAWINGS

FIG. 1 is a cross sectional view taken through a hand-thrown projectile embodying features of the invention. The projectile is shown in a position it might take immediately prior to striking a target, shown fragmentarily in FIG. 1 below the projectile.

DESCRIPTION OF A PREFERRED EMBODIMENT OF THE INVENTION

Figure 2:
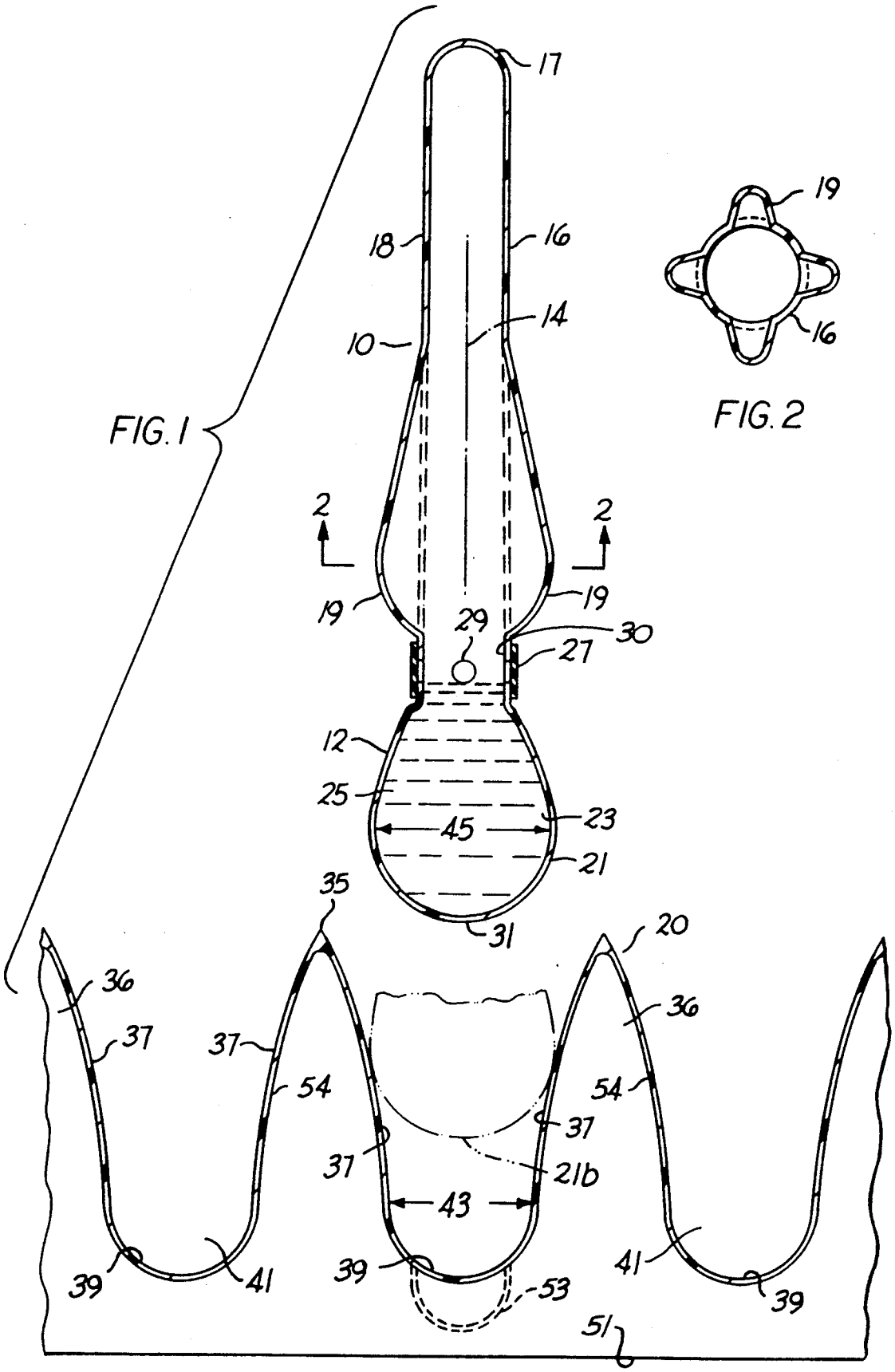
FIG. 2 is a cross-sectional view taken on line 2—2 in FIG. 1.

Referring to FIG. 1, a hand-thrown projectile 10 comprises an elongated hollow body 12 symmetrical around a central longitudinal axis 14. The projectile body includes a hollow tubular handle portion 16 having a circular cross section. The upper end 17 of the handle portion is semi-spherical.

As best seen in FIG. 2, four hollow protuberances 19 are formed at circumferentially spaced points around handle portion 16. Each protuberance has the configuration depicted in FIG. 1. The protuberances resemble the fins commonly used on archery arrows.

The handle area 18 between end 17 and fins 19 is smooth and unencumbered, such that a user can grasp handle area 18 to throw the projectile toward a ground target. As viewed in FIG. 1, the projectile is shown descending vertically toward ground target 20.

Normally, two ground targets are spaced 30 to 50 feet apart. Two players stand near one ground target and throw projectiles 10 toward the other target. Points are scored, based on where the projectiles land in relation to the target.

Two or four players play the game. If four players are playing, two players remain near each ground target. They use the projectiles thrown by the other two players.

Referring again to FIG. 1, projectile body 12 comprises a relatively short hollow nose portion 21 extending forwardly (downwardly) from handle portion 16. The nose portion has a diameter that is greater than the diameter of handle portion 16, forming a relatively large diameter chamber 23 within the nose portion. Water or other high density granular pellet material 25 is located within nose portion 21 so that the weight of the projectile is concentrated primarily in nose portion 21 (rather than being distributed uniformly along the length of the projectile).

The projectile is thrown with an underhanded swinging motion in pendulum fashion with nose portion 21 at the lower (outer) end of the swinging arc. Filler material 25 is concentrated in nose portion 21 so that when the user releases his grip on handle portion 16, nose portion 21 constitutes the leading end of the projectile. The projectile will take an arcuate flight path toward the target, with the trajectory varying according to how the person throws and releases the projectile. As seen in FIG. 1, the projectile is descending toward the target in a vertical direction (with the nose portion in the lead). Various other projectile trajectories are possible with various descent angles, ranging from vertical to near horizontal.

Filler material 25 can be introduced into chamber 23 in various ways. The FIG. 1 projectile has four circular filler holes 29 formed in tubular portion 30 near nose portion 21. A resilient rubber band 27 encircles the tubular portion, sealing holes 29 shut. With band 27 removed from the body, the body can be inserted nose first into a body of water. The water flows through holes 29 and then downwardly into chamber 23. The body can be lifted out of the water after which rubber band 27 is stretched over nose portion 21 to assume the FIG. 1 position, sealing the filler holes shut. The rubber band can be cemented to the surface of tubular portion 30, or alternatively held against tubular portion 30 by the band's elasticity.

The front end surface 31 of the nose portion has a convex rounded curvature that is relatively blunt, i.e. non-pointed. Should a user throw the projectile body at another person, the blunt nose surface 31 has a relatively large contact area to prevent penetrating the other person's skin. The nose configuration is designed to minimize personal injury dangers that are associated with conventional lawn darts.

As a further protection against personal injury, the projectile is formed as a one-piece hollow body of thin walled plastic material. The wall thickness of the hollow plastic body is relatively small, e.g. less than 0.1 inch, such that the wall material can be readily deformed by concentrated pressure on the wall outer surface. Nose portion 21 has a continuously curved outer with a bulbous configuration. Front end surface 31 of the nose portion is essentially semi-spherical. Should the projectile forcibly strike a person's body, the impact will be at least partially dissipated by a localized inward deflection of the hollow body wall. As noted above, the thin plastic wall is capable of inward deflection in a fashion not possible with solid, rigid materials commonly used in conventional lawn dart construction.

The hollow projectile body can be constructed in various sizes and dimensions. Typically the hollow body has a total length of about ten inches. Handle portion 16 has a diameter of about one inch, and bulbous nose portion 21 has a diameter of about two inches.

Figure 5:
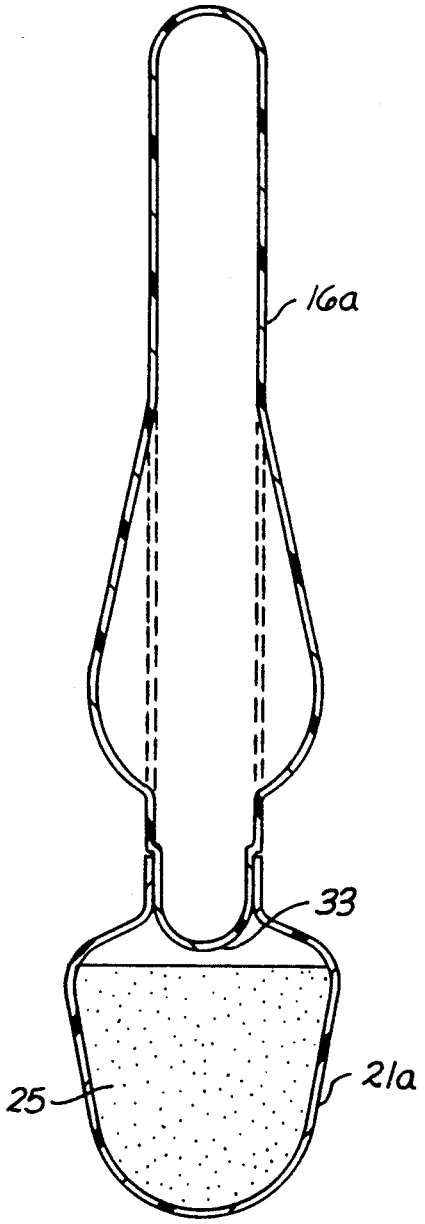
FIG. 5 is a view taken in the same direction as FIG. 1, but illustrating another projectile embodying features of the invention.

FIG. 1 represents the preferred projectile configuration. However, within the broader aspects of the invention, other projectile constructions are possible. FIG. 5 shows a less preferred construction, wherein the hollow tubular handle portion **16*a* is formed separately from the hollow nose portion 21*a*. End portion 33 of handle portion 16*a* is inserted into the open mouth of nose portion 21*a*. Adhesive permanently secures the nose portion and handle portion together. Prior to joining the handle and nose components together, the high density filler material 25** is poured into the nose portion through its open mouth. The filler material can be water, sand, metal pellets, or other high density granular material.

Figure 3:
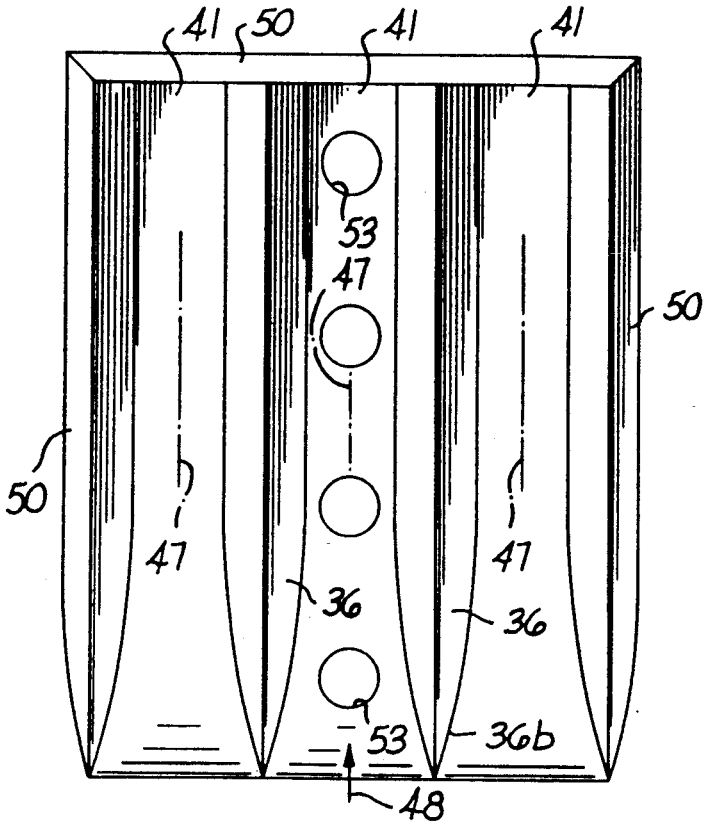
FIG. 3 is a plan view of the target shown in FIG. 1, but on a reduced scale.
Figure 4:
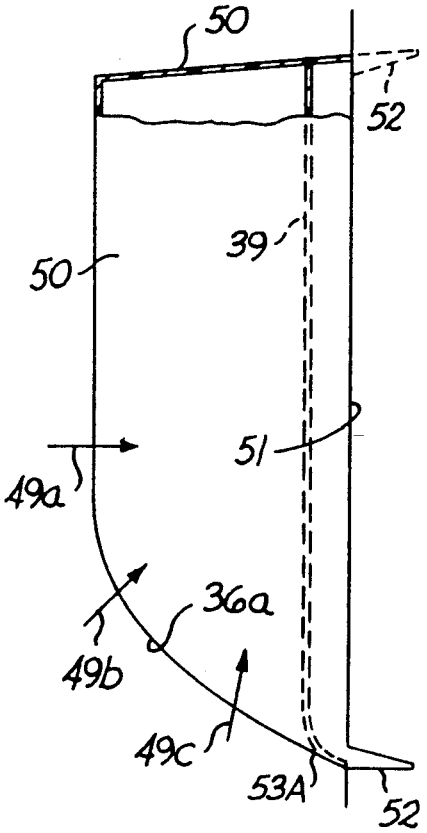
FIG. 4 is a side elevational view of the target of FIG. 3, with a small portion shown in section.

FIGS. 1, 3 and 4 illustrate a ground target 20 that can be used with the FIG. 1 projectile in the practice of the invention. Target 20 has a body formed as a one-piece plastic molding having a relatively thin wall thickness, typically less than 0.1 inch. Upper surface 35 of the target body forms a series of hollow parallel upstanding partitions 36 having side surfaces 37 joined to semi-circular cross-sectioned bottom walls 39 to form three upwardly opening troughs or depressions 41. The opposed side surfaces 37 of each trough angle away from each other in the upward direction, so that the trough (depression) converges downwardly.

The minimum distance between the trough side surfaces, as denoted by numeral 43 in FIG. 1, is less than the corresponding diameter of the projectile nose portion 21, as denoted by numeral 45. The maximum distance between the trough side surfaces (at the upper edges of partitions 36) may be 2 to 3 times the minimum distance. Therefore, when the projectile is descending into the trough, the trough side walls tend to grip the nose portion side surfaces. The dashed line **21*b* in FIG. 1** shows the projectile nose portion as it comes into contact with the trough side walls.

As the projectile nose portion travels downwardly into the trough, the trough side walls may spread slightly due to the impact of the projectile. The wall spreading action absorbs the kinetic energy of the projectile, such that in its final position, the projectile is wedged in the trough. By making the trough side walls thin and deformable, the target body effectively prevents the projectile from rebounding out of its wedged deformed position in the trough.

FIG. 3 shows the elongated nature of the three trough like depressions 41. The longitudinal centerline of each depression is referenced by numeral 47. The target is oriented on the ground surface so that trough centerlines 47 are parallel to a vertical plane extending through the intended flight path of the projectile. In FIG. 3 a representative projectile flight path is designated by numeral 48.

With the target body oriented as described above, the projectile can have a range of different trajectories while still achieving a wedge fit in one of the target depressions (troughs). FIG. 4 shows three such possible descent angles 49*a*, 49*b*, and 49*c*. The upstanding partitions 36 have sloped leading edges, as shown at 36*a* in FIG. 4. Also the partitions are narrowed at their leading ends, as shown at 36*b* in FIG. 3, whereby each trough 41 has a horizontally accessible divergent mouth facing the oncoming projectile. The projectile can enter into the trough even with a near horizontal approach angle, as shown at 49*c* in FIG. 4. The aim is to provide a ground target that can accommodate projectiles having a range of different trajectories (e.g. a high arc or a low arc).

The game can be played with a ground target having a single trough-like depression 41. The reason for multiple depressions is to permit different point values for each trough, e.g. the central trough might have a higher point value than the other two troughs.

As shown in FIG. 3, the target has a generally rectangular plan configuration defined by three downwardly extending rim walls 50. The rim walls have a common lower edge 51 that rests on the ground surface. Each corner (defined by the intersecting rim walls) has a ground penetrating prong 52 extending downwardly from rim lower edge 51, to prevent the target body from laterally shifting upon impact by a projectile. Each prong 52 preferably is integral with two intersecting rim walls, such that each prong has a right angle cross section for strength purposes. The front rim wall 53A is curved as illustrated in FIG. 4.

As an optional feature, one or more of the trough bottom walls 39 has a number of downwardly extending sockets 53 mated to the spherical end surface 17 on the projectile handle. By inserting the projectile handle ends 17 into sockets 53, the projectiles can be stored in upright positions on the target body, e.g. when the game is not being played.

During shipment, the projectiles may be stored in prone positions within the cavities 54 formed by side surfaces 37. Also, two or more target bodies can be stacked together in a nested relationship. To promote the stacking process, each target body has its rim walls 50 sloped outwardly to a slight extent, as shown in FIG. 4. The target body walls are relatively thin such that the lower surface of the contoured plastic wall forms the reverse curvature of the target body upper surface, whereby one target body can be stacked partially within another target body.

The drawings show specific features useful in practice of the invention. However, it will be appreciated that the invention can be practiced in various forms.

Having described my invention, I claim:

1. A hand-thrown projectile comprising an elongated hollow projectile body having a central axis; said hollow projectile body having a relatively long hollow tubular handle portion symmetrical about the central axis, and a relatively short hollow nose portion extending forwardly from said tubular handle portion, said hollow nose portion being symmetrical around said central axis; said hollow nose portion having a diameter that is appreciably greater than the diameter of said handle portion; and a quantity of high density filler material located within the hollow nose portion whereby the relatively short nose portion is significantly heavier than the relatively long handle portion; the handle portion of said projectile being adapted to be grasped by a person's hand, whereby the projectile can be thrown with an underhand swinging motion, such that the projectile flies out into space, with the nose portion constituting the leading end of the projectile; said hollow nose portion having a blunt front end surface, such that if the nose portion strikes a person's body the blunt end surface is incapable of penetrating the person's skin.

2. The projectile of claim 1, wherein said high density filler material is a flowable material selected from a group consisting of water and sand.

3. The projectile of claim 1, wherein said hollow projectile body is a one piece plastic body having a continuous skin containing the filler material.

4. The projectile of claim 31 and further comprising at least one filler hole in said tubular handle portion in near proximity to said hollow nose portion, whereby the projectile nose portion can be inserted downwardly into a body of water so that water can flow through said filler hole to form the filler material for the projectile.

5. The projectile of claim 4, and further comprising a resilient band adapted to be stretched around the tubular handle portion; said resilient band having a width dimension that is greater than the corresponding dimension of the filler hole, whereby the band can be located on the tubular handle portion to block the hole to prevent the escape of the liquid filler material.

6. The projectile of claim 1, wherein the blunt front end surface of said nose portion has a convex rounded curvature, and the handle portion has a rear rounded end.

7. The projectile of claim 1, wherein said hollow projectile body is a one piece plastic body having a continuous skin that forms a chamber for the high density filler material; said plastic body having a substantially uniform wall thickness at all points therealong.

8. The projectile of claim 7, and further comprising a plurality of hollow fins extending laterally outwardly from said tubular handle portion at circumferentially spaced points therearound; said fins being hollow protuberances integral with the projectile body.

9. The projectile of claim 8, wherein said fins are located near the forward end of the hollow tubular handle portion, such that the area of the handle portion behind the fins can be grasped for purposes of throwing the projectile.

10. The projectile of claim 7, wherein the wall thickness of the hollow body is sufficiently small that the hollow nose portion can be readily deformed by manual pressure on the outer surface thereof.

11. The projectile of claim 1, wherein said hollow nose portion has a continuously curved outer surface forming a bulbous configuration; the blunt front end surface of said nose portion having an essentially spherical contour.

12. A ground target for a hand-thrown projectile having a nose portion comprising a target body having a lower surface adapted to rest on the ground, and an upper deformable surface adapted to grip the nose portion of a thrown projectile; said target body upper surface having at least one depression therein, said depression having opposed deformable side surfaces, and a bottom surface spanning said side surfaces; said opposed side surfaces being angled away from each other in the upward direction, whereby the depression converges in the downward direction; said opposed side surfaces having a minimum spacing that is substantially less than the diameter of the nose portion on the thrown projectile, whereby the projectile nose portion is enabled to have a wedge fit in the target depression.

13. The ground target of claim 12, wherein the depression in said target body is an elongated trough having parallel upwardly diverging side surfaces; said target body being disposed so that the elongated trough extends parallel to a vertical plane extending through the intended flight path of the thrown projectile, whereby the thrown projectile can have a range of different trajectories while achieving a wedge fit in the ground target depression.

14. The ground target of claim 13, wherein said elongated trough has a horizontally accessible divergent mouth at one end thereof, whereby a projectile can enter into the trough while moving along an essentially horizontal path.

15. The ground target of claim 14, wherein the trough side surfaces have upper horizontal edges spaced by a distance that is at least twice the diameter of the projectile nose portion, whereby the trough side surfaces can exert cam forces on the nose portion of a downwardly moving projectile.

16. The ground target of claim 15, wherein said elongated trough has a bottom surface extending longitudinally therealong, and a plurality of downwardly extending sockets indented into said bottom surface at spaced points therealong; each socket being sized to grip the end of a handle on an associated projectile, whereby a number of projectiles can be stored in inverted positions on the ground target.

17. The ground target of claim 12, wherein said target body comprises a relatively thin plastic wall configured to define the upper and lower surfaces of the target body; said thin plastic wall having an essentially uniform thickness at all points therealong, whereby the lower surface of the plastic wall forms the negative reverse curvature of the target body upper surface.

18. The ground target of claim 17, wherein said plastic wall is deformable, whereby the side surfaces of said depression can move apart in response to impact by the nose portion of a thrown projectile.

19. The ground target of claim 17, wherein said thin plastic wall comprises a peripheral rim extending downwardly from the target body upper surface to define a peripheral lower edge located below the plane of the depression bottom surface; said rim being sloped so that two similarly-configured target bodies can be stacked together in a nested relationship.

20. The ground target of claim 19, and further comprising a plurality of ground-penetrating prongs formed integrally with said rim, each prong extending downwardly from the rim lower edge; said target body having a rectangular plan configuration so that the rim comprises a plural number of rim walls joined together to form rim corners; said ground-penetrating prongs being located at the rim corners, with each prong having a right angle cross section.

* * * * *